US008371077B2

(12) United States Patent
Delhomme

(10) Patent No.: US 8,371,077 B2
(45) Date of Patent: Feb. 12, 2013

(54) ROLL-AWAY STAIRCASE

(76) Inventor: Danielle Delhomme, Abilene, TX (US)

( * ) Notice: Subject to any disclaimer, the term of this patent is extended or adjusted under 35 U.S.C. 154(b) by 41 days.

(21) Appl. No.: 12/788,884

(22) Filed: May 27, 2010

(65) Prior Publication Data

US 2011/0289868 A1 Dec. 1, 2011

(51) Int. Cl.
*E04F 11/00* (2006.01)

(52) U.S. Cl. ..... 52/183; 182/93

(58) Field of Classification Search ..... 52/6, 8, 52/182, 183; 244/129.6; 182/1, 93, 106
See application file for complete search history.

(56) References Cited

U.S. PATENT DOCUMENTS

| | | | | |
|---|---|---|---|---|
| 479,436 | A * | 7/1892 | Lummus | 182/1 |
| 1,811,706 | A * | 6/1931 | Bessler | 182/81 |
| 1,814,889 | A * | 7/1931 | Bessler | 182/80 |
| 3,912,298 | A * | 10/1975 | Humphrey | 280/166 |

* cited by examiner

*Primary Examiner* — William Gilbert
*Assistant Examiner* — Gisele Ford
(74) *Attorney, Agent, or Firm* — Megan E. Lyman

(57) ABSTRACT

This invention relates generally to a staircase that can roll to an upright position when not in use and considers safety standards. More particularly, the invention is directed to a staircase that can be used where space is limited as the staircase's footprint can be minimized when not in use.

14 Claims, 7 Drawing Sheets

ROLL-AWAY STAIRCASE

FIELD OF THE INVENTION

This invention relates generally to a staircase that can roll to an upright position when not in use and considers safety standards. More particularly, the invention is directed to a staircase that can be used where space is limited as the staircase's footprint can be minimized when not in use.

BACKGROUND

Stairway ladders generally include a series of stairs arranged in an ascending pattern in relation to each other so that a user may ascend from ground level to a higher level or descend therefrom. The stairs are arranged in any of a variety of slopes extending from the bottom front of the stairs to the top of the stairs. The topmost step is generally supported by the stairs at the front end and additionally supported at the back end, where the additional support is generally vertical in nature. This configuration allows for the topmost step and back end of the ladder to be placed flush or close to an area of interest above ground level, so that a user can access such area of interest.

Stairway ladders are used in any number of environments, including those where goods, supplies, crates, cartons, or any other items are stored, stocked, transferred to and from, or placed at locations otherwise out of reach of persons desiring access to them. Thus, stairway ladders find use in any of a variety of environments, ranging from large industrial warehouses, distribution centers, and large retail warehouses, to smaller stock rooms, store rooms and other back rooms. Stairway ladders are likewise finding use outside of stock rooms in the consumer or retail areas of commercial establishments. For example, use by retail store personnel or consumers to retrieve items placed on high shelving along store aisles is common.

Stairway ladders generally cannot be minimized, and thus may obstruct aisles, warehouse space where forklifts or other heavy equipment needs to maneuver, or otherwise be in the way when not in use. Stairway ladders that can be folded such that the length of the stairway is minimized suffer from various drawbacks and disadvantages. For example, the folding systems of such stairway ladders are generally not manually operable or foldable, meaning that a user generally must use tools to take apart certain structures of the ladder in order to fold it. This is burdensome for a user for a variety of reasons. It is difficult to take apart the structure quickly, especially if the user is either not accustomed to using tools, or does not have the strength to handle the individual parts of the stairway ladder. The folding operation associated with current stairway ladders is sometimes not ideal, and may place physical demands on the user that would be preferable to avoid. Still further, the disassembly and reassembly time may be considerable depending on the proficiency of the person handling the foldable stairway ladder. Moreover, space within the stairway's environment may be insufficient to allow a user to breakdown the stairway ladder easily, if at all.

The Occupational Safety and Health Administration's ("OSHAs") regulations are codified in 29 CFR. 29 CFR 1910.24 contains "specifications for the design and construction of fixed general industrial stairs." In addition to naming environments where stairways are required, specifications outlined include stair strength, stair width, height of stairway rise, size of stair treads and stairway platforms, railings and handrails, and vertical clearance. Stairways that conform, or integrate some of the characteristics of OSHAs regulations are attractive to many corporations wishing to remain in compliance. Currently, no stairway exists that can remain in place, yet be minimized in terms of its footprint, while considering and implementing some of the safety features outlined by OSHA.

Thus, there is a need for a stairway ladder that can minimize the space it takes up when not in use, while at the same time considering outlined safety standards.

SUMMARY OF THE INVENTION

According to one aspect of the present invention, the roll-away stairway comprises a stairway section adapted for a user to go up or down, with the use of handrails, wherein the integrity and safety of the staircase is considered, i.e., the rise over run, size of stair treads and height of the handrails satisfy the requirements of OSHA.

According to another aspect of the present invention, the roll-away stairway of the present invention can be affixed to a wall where it may be put into the useable position or the stowing position as needed.

Additionally, according to yet another aspect of the present invention, the stairway uses four wheels to expand from a stowing position to a useable position. Two wheels located at the bottom of the staircase, along with two other wheels affixed to a mounting plate and rolling within two tracks attached beneath the upper one-third of the staircase, allow it to roll into a closed position. The frame of the stairway changes from an approximate 45 degree angle with relationship to the floor when it is in the useable position to approximately 90 degrees in the stowing position. The steps of the stairway of the present invention move from horizontal when in use to an approximate 45 degree angle relative to the wall and the floor when they are stowed.

Moreover, in another aspect of the present invention, to comply with the OSHA standard that requires that the stairway be affixed at both the top and bottom of the stairway, the bottom of the stairway is capable of being secured in a fixed position. The top of the stairway is affixed to the upper surface to which the stairway terminates in the useable position by means of the wall mount assembly, using three points of contact—two wheels and an interlocking assembly of steel pieces (see FIG. 4).

In yet another aspect of the present invention, the handrails of the present invention are collapsible, so that the handrails can fold inward and rest on the steps of the stairway, minimizing the footprint of the present invention.

An object of the present invention is to provide a staircase that can minimize its footprint by 86.5% when in its stowing position versus in its useable position.

Another object of the present invention is to provide a staircase that adheres to multiple OSHA standards, and is attractive to corporations that are either required or wish to comply with those standards.

Yet another object of the present invention is to provide a convenient and useable apparatus to ascend to another level that is safe and efficient.

BRIEF DESCRIPTION OF THE DRAWINGS

The foregoing aspects and many of the accompanying advantages of this invention will become more readily appreciated as the same becomes understood by reference to the following detailed description, when taken in conjunction with the accompanying drawings, wherein.

DETAILED DESCRIPTION

The invention described in detail herein generally relates to a roll-away stairway.

Figure 4:
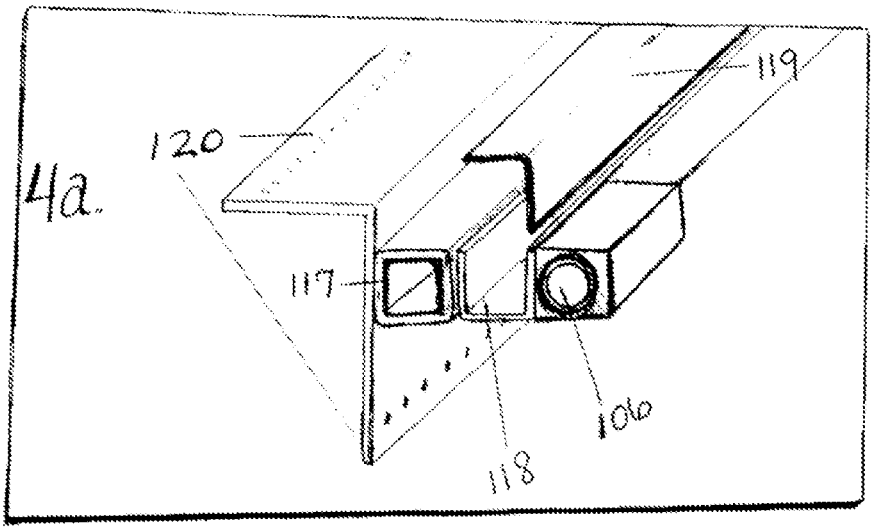
FIG. 4*a* is a view of the mounting bracket that attaches the stairway to the upper surface.
FIG. 4*b* is a frontal view of the mounting bracket that attaches to the upper surface and the stairway, as in one embodiment of the present invention.
FIG. 4*c* is a side view of the angle iron and steel tubing used in the mounting bracket, as in one embodiment of the present invention.
Figure 4:
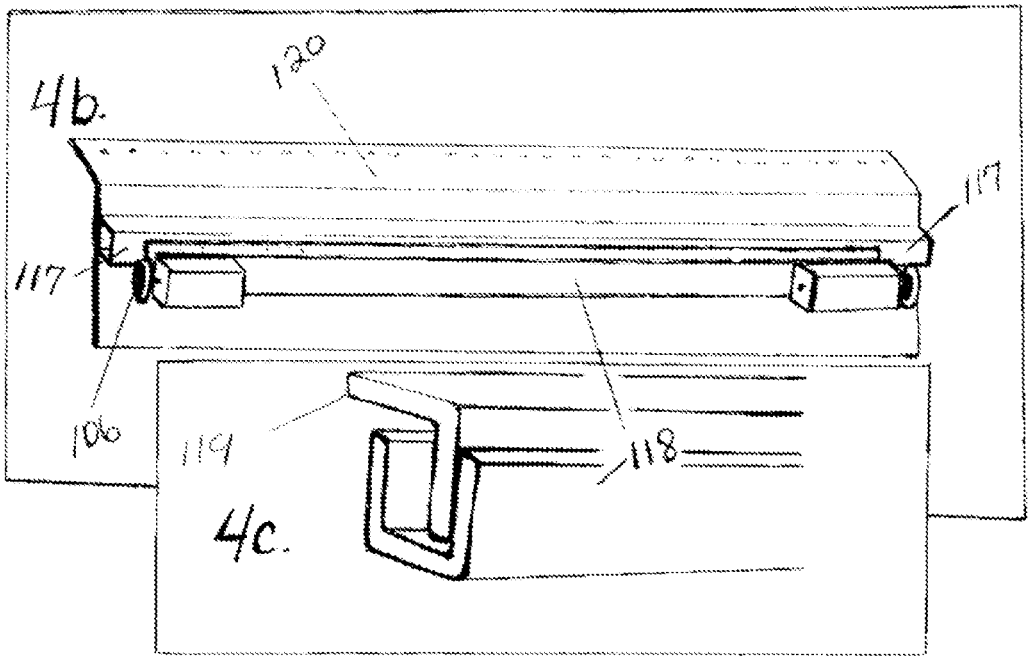

The stairway can be rolled downward into the useable position, where its footprint is approximately 10 feet×34 inches. When the stairway is in the upright, stowing position, and not in use, its footprint is approximately 16 inches×34 inches. The stairway of the present invention is affixed to the upper surface at its upper end by two wheels attached to the wall mount assembly 116, which is attached to the upper surface (see FIGS. 1 and 4), rolling inside two rails (see FIGS. 7*a* and 7*b*), attached underneath the approximate top one-third of the stairway (see FIG. 1). In this embodiment, the stairway is used to reach only that upper surface; it is not moved to another environment for use. The stairway is always connected to the upper surface by at least two points of contact. In one preferred embodiment, the two wheels 106, permanently affixed to each side of the wall mount assembly 116, roll inside the rails 104 which are attached to the bottom of the framework of the stairway (see FIGS. 7*a* and 7*b*. As shown in FIGS. 4*a*, 4*b*, and 4*c*, in one embodiment the wall mount assembly 116 is permanently affixed at the top of the wall by a 6.75"×4"×48" piece of angle iron 120, with its vertical flange attached to the wall studs and its horizontal flange attached to the ceiling joists. The wall mount assembly 116 can be affixed through the use of a fastener, such as 3 inch screws, lag bolts or other means. Other means of affixing the angle iron 116 to the upper surface are contemplated by those skilled in the art and do not depart from the present invention. When the stairway is rolled completely out into the useable position, a third point of contact between the stairway and the wall mount assembly exists; a piece of angle iron 119 attached beneath the top step of the stairway interlocks with a u-shaped metal piece 118 attached to the spacer, holding the top of the stairway firmly in place, level with the upper surface.

As shown in FIG. 4, a piece of square steel tubing 117 can be welded to the angle iron 120, as in one preferred embodiment. The piece of square steel tubing 117 is used as a supportive spacer. A second u-shaped piece of iron 118 is attached to the piece of steel tubing 117. A third piece of angle iron 119, affixed permanently underneath the top step, fits into and interlocks with the u-shaped piece 118 on the mounting plate only when it is fully extended in the useable position. Other methods of permanently affixing the stairway to the upper surface will be contemplated by those skilled in the art and do not depart from the scope of the present invention.

Figure 1:
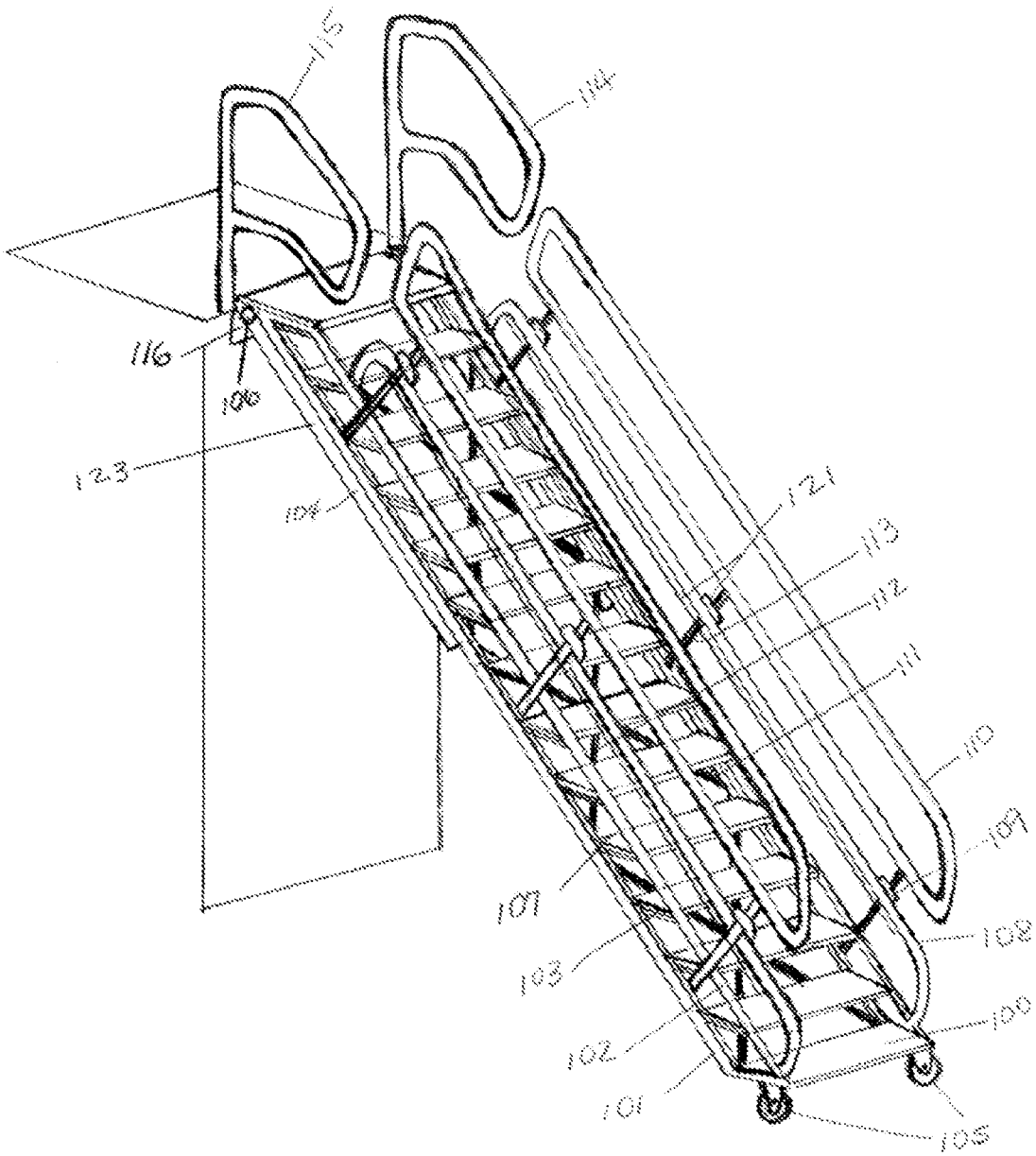
FIG. 1 is an orthogonal view of the roll-away stairway apparatus in its useable position, as in one embodiment of the present invention.

Affixed to the upper surface to which the stairway terminates in its useable position are two permanent handrails, 114 and 115, on either side of the stairway. These handrails, 114 and 115, facilitate safe passage of the user as they reach the upper surface. The handrails 114 and 115 are at a height of approximately 43 inches from the upper surface, extend horizontally approximately 11 inches, then extend downward at approximately a 45 degree angle, for about 30 inches (or less as in other embodiments so that they extend no farther than the steps in their stowed position), such that when the stairway is in its useable position the two handrails 114 and 115 are nearly adjacent to or overlap the handrails 110 of the stairway. As shown in FIG. 1, the two handrails 114 and 115 have an upper and lower portion, making a P-shape, for structural integrity and stability, as in one preferred embodiment. Other shapes for the two handrails 114 and 115 can be used without departing from the scope of the present invention. In another embodiment of the present invention, the two handrails 114 and 115 do not extend beyond the upper surface any more than the staircase does when in the stowing position (i.e., approximately 16-18 inches).

Figure 6:
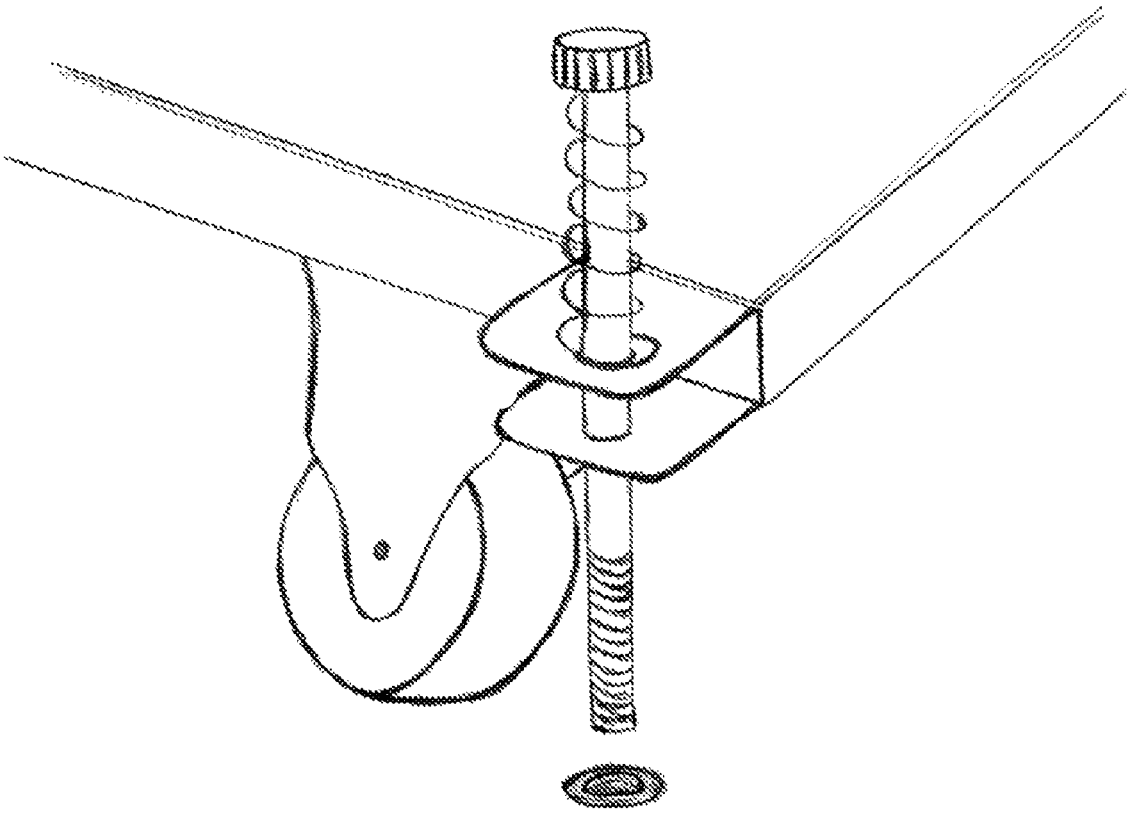
FIG. 6 is a view of the fastener at the bottom of the staircase that can be fastened to the floor when desired, as in one embodiment of the present invention.

The lower portion of the stairway can be affixed when needed in its useable position, as seen in FIG. 6. In one embodiment, where it is desirable to affix the lower portion of the stairway to conform to OSHA standards, a threaded pin 124 is attached to each side of the frame at piece 103 by a bracket 125. A tapped anchor is countersunk into the floor, level with the floor that the stairway rests on (see FIG. 6). The threaded pin 124 slides through the bracket 125 at the bottom of the staircase and screws into the tapped anchor countersunk into the floor. This method of affixing the bottom of the stairway is quickly released by unscrewing the knobs on the locking pins. Other methods of anchoring the stairway to the floor may be contemplated to those skilled in the art but do not depart from the scope of the present invention.

Two pairs of wheels 105 and 106, four total, are used to roll the stairway from its stowing position to its useable position and vice versa. The first pair 105 is placed on each side of the metal framework by the bottom step and is in contact with the floor, this pair of wheels operates to roll the stairway back and forth into the useable position. The second pair of wheels 106 roll in a rail 104, attached to the top third of the stairway, and allows the stairway to roll up to vertical (the stowing position) and down to the useable position on a pivot point while maintaining contact with the upper surface as the stairway moves back and forth. The second pair of wheels 106 is affixed to the wall, as part of the wall mount assembly 116 described above (see FIGS. 1 and 4), and roll in tracks 104 which are affixed to the stairway. The tracks 104 move up and down as the stairway moves from the stowing position to the useable position. The vertical change in the height of the top step relative to the floor between the useable position and the stowing position is approximately 4 feet 2 inches in a preferred embodiment.

Figure 7A:
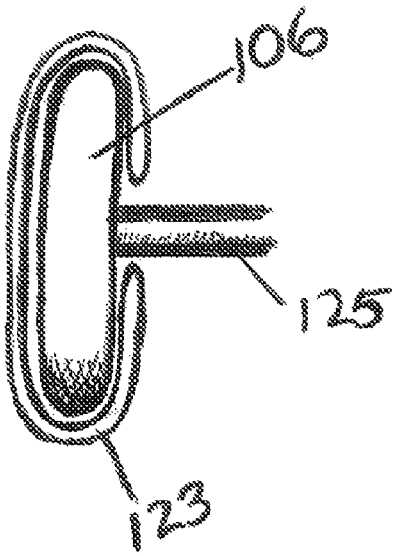
FIG. 7*a* is a side view of an upper wheel within a rail, as in one embodiment of the present invention.
Figure 7B:
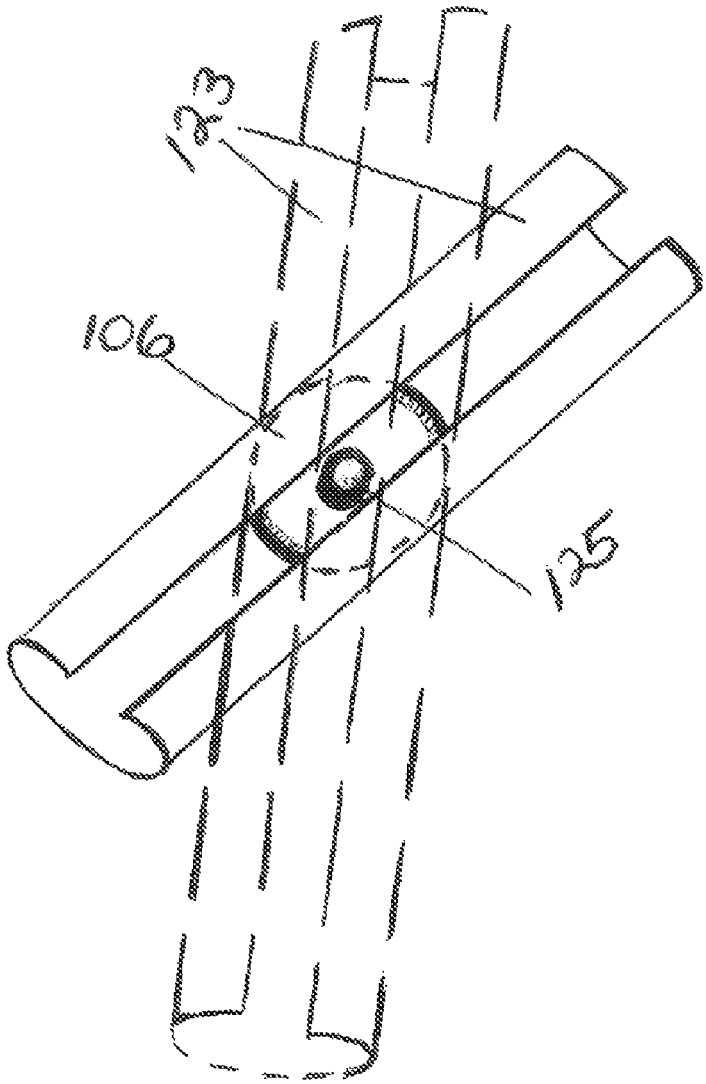
FIG. 7*b* is a frontal view of an upper wheel within a track, illustrating the free movement of the rail, as in one embodiment of the present invention.

As shown in FIGS. 7*a* and 7*b*, the upper wheels 106 are positioned inside a track 104 that rolls upward on the pivot point of the wheels 106 when the stairway is moved from the useable position to the stowing position, and downward on the wheels 106 when the stairway is moved from the stowing position to the useable position. In one embodiment, the tracks 104 that house the upper wheels 106 can operate similar to that of common garage door tracks. In one preferred embodiment, the stairway's vertical height in its useable position is approximately 8 feet 10 inches, and when it is in its stowing position is approximately 13 feet.

The bottom wheels 105 are able to move forward and backward as the stairway is moved from the outward, useable position, to the stowing position that is near vertical. The bottom wheels 105, in one preferred embodiment of the present invention, are freely moving. A user may wish to anchor the wheels 105 into the outward, useable position, and may do so without departing from the scope of the invention (as described above, and seen in FIG. 6).

The use of wheels at the bottom of the stairway 105 and top 106, as part of the mounting assembly, with the tracks 104, allows the stairway to be manually pushed, or rolled, from the useable position to the stowing position, and vice versa. It is contemplated that motorized mechanisms could be employed to move the stairway as well, as would be apparent to those skilled in the art. In one preferred embodiment, the stairway is moved from the useable to stowing position by a hand-cranked winch. In addition, a torsion spring or counterweights could be applied for ease of movement.

In one preferred embodiment of the invention, approximately 13 steps comprise the stairway. Each step 100 measures approximately 33 inches wide by 9 inches deep. Moreover, each step 100 can be covered by an anti-skid covering, as in the preferred embodiment, to enhance the safety of the stairway. The anti-skid covering can be made of a variety of materials including plastics, polymers, synthetics, rubbers and the like. Each step 100 has a vertical distance to the step above it of about 8 inches. The dimensions of each step, the vertical distance and the anti-skid covering comply with OSHA standards, as in one preferred embodiment of the present invention. As will be contemplated by those skilled in the art, steps of differing numbers or dimensions will not depart from the scope of the invention.

Pieces 107 and 103 support and connect the back and side of each step 100 respectively to the frame of the stairway. Piece 103 connects with the two bars 101 and 102 that make up the sides of the main supporting framework. In one preferred embodiment, the supporting piece 107 is 1 inch angle iron. Each supporting piece 107 and 103 faces inward, toward the steps 100, with the flat horizontal sides adjacent to the stair step 100 for securing the step to the pieces of angle iron and the vertical sides facing downward adjacent to the metal framework.

The stairway of the present invention moves from the stowing position, where the steps 100 are approximately 45 degrees to the floor, to the useable position where the steps are approximately horizontal in the preferred embodiment of the invention. The distance between the two pieces of parallel angle iron 101 and 102 that make up the main frame secure each step 100 on its front and back side is about 9 inches. Other means of securing the step to the framework of the stairway are contemplated and do not depart from the scope of this invention.

A piece of pipe 108 is welded parallel to the two pieces of angle iron 101 and 102 that form the sides of the metal framework of the stairway, forming the fixed base of the handrail. In one preferred embodiment the pipe is 1 inch in diameter. Other materials besides pipe may be used for the pipe segment such as, but not limited to, solid metals, wood, plastics, resins, fiberglass and the like. The pipe 108 runs parallel to the second angle iron 102 at a distance of approximately 10½ inches. The pipe 108 is welded directly to angle iron 102, and reinforced by a plurality of pieces of angle iron 113. In one preferred embodiment, three pieces of angle iron 113 are present on each side of the stairway, and are positioned in the middle and at the upper and lower ends. Since the pieces of angle iron 113 are present on both sides of the stairway, approximately 6 pieces of angle iron 113 are present, as in the preferred embodiment. The pieces may be affixed to the pipe and two pieces of angle iron, 101, 102 and 108 by welding or other means known to those of skill in the art. All of these elements, and others of the present invention, may be made of metal or other material that adds strength and integrity to the stairway.

Figure 2:
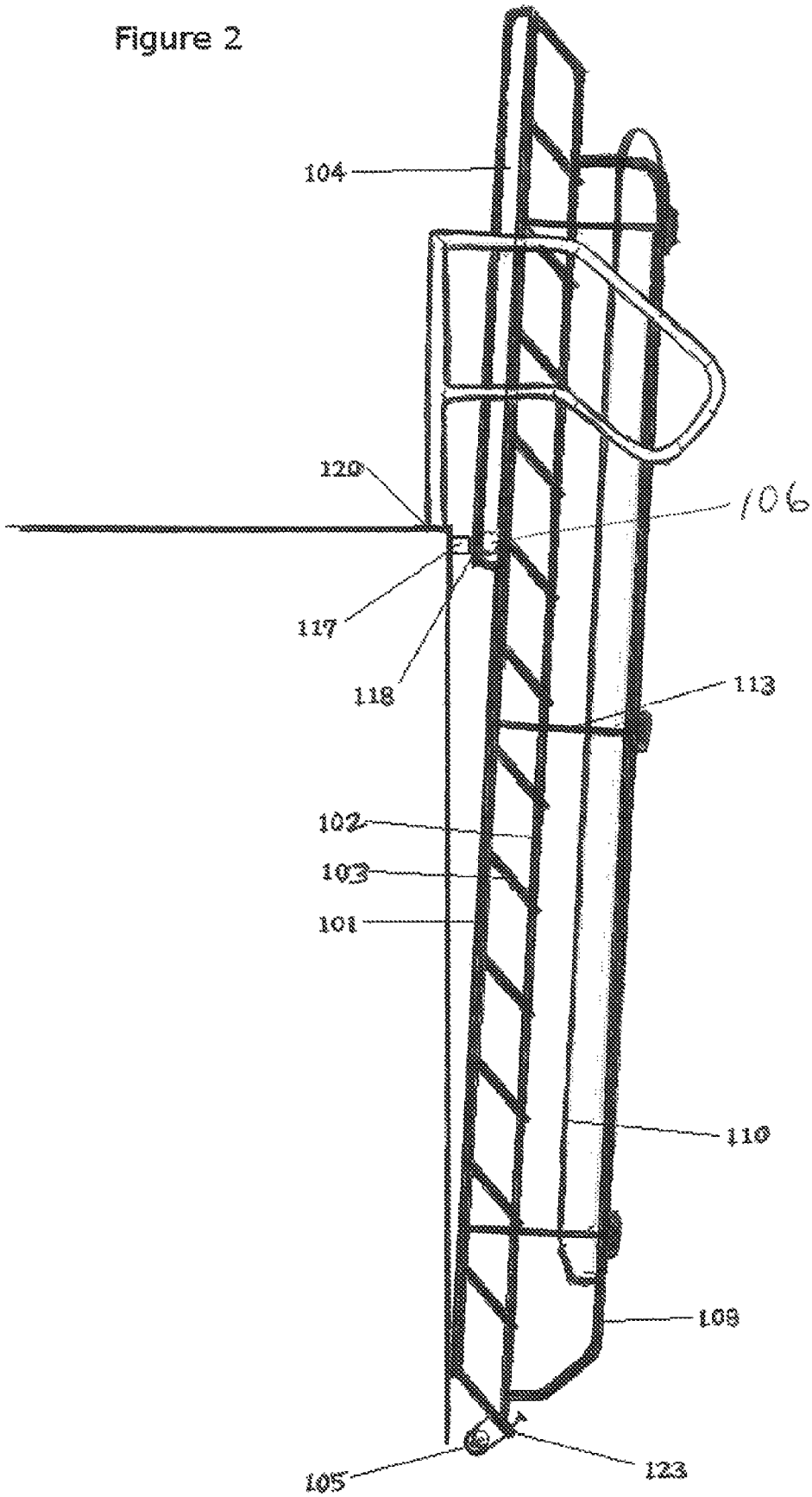
FIG. 2 a side view of the roll-away stairway in its stowed position, as in one embodiment of the present invention.
Figure 3:
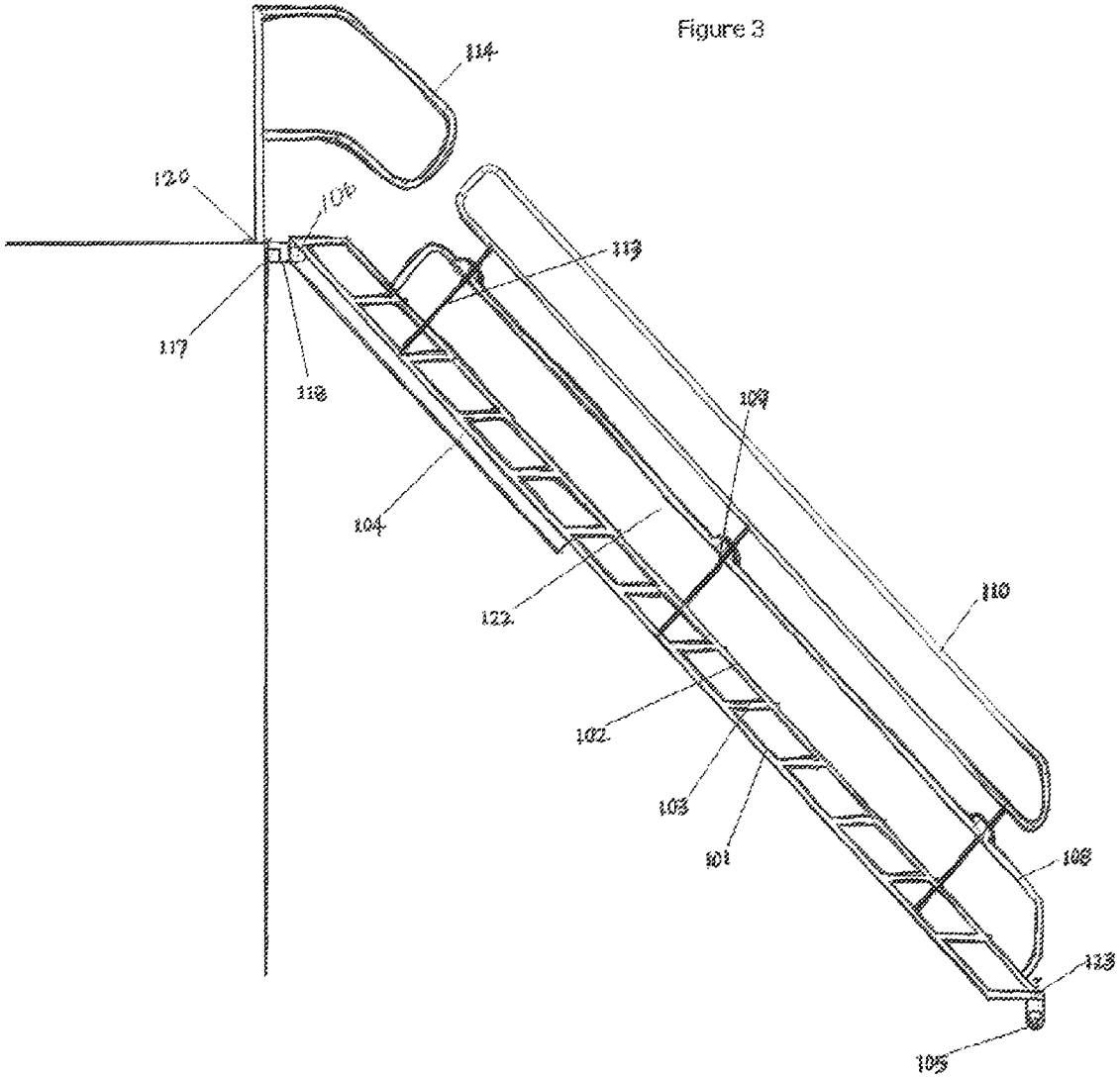
FIG. 3 is a side view of the roll-away stairway in its useable position, as in one embodiment of the present invention.
Figure 5:
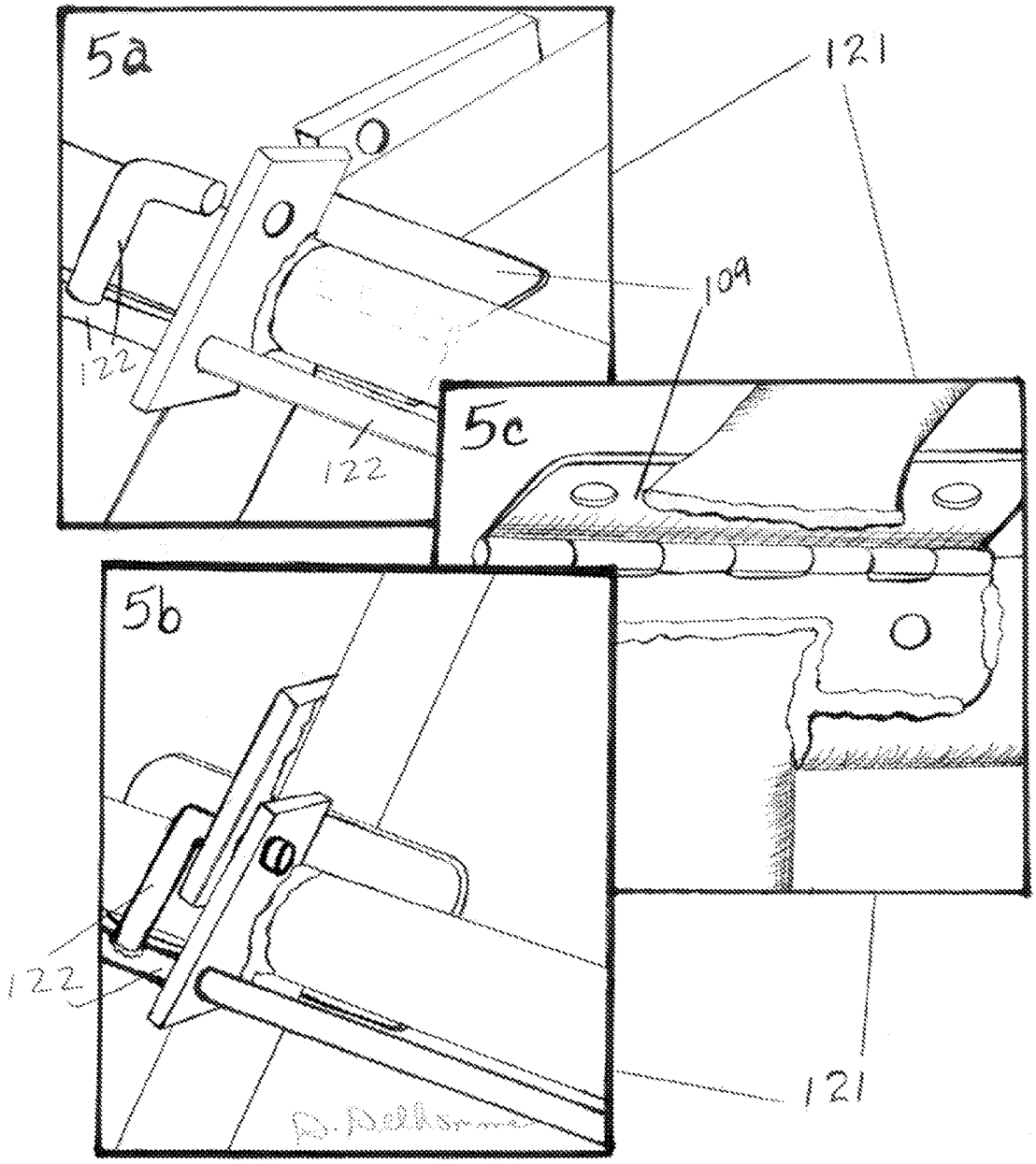
FIG. 5*a* is an illustration of the connection piece that allows the stairway handrails to be secured into the upright position, as in one embodiment of the present invention.
FIG. 5*b* is an illustration of the pin locked in place to secure the handrails in the useable position, as in one embodiment of the present invention.
FIG. 5*c* shows the hinge that allows the handrails to fold inward on the stairway and outward to the useable position, as in one embodiment of the present invention.

The pipe 108 is part of the structural framework of the stairway, and also serves as the base of the handrail. The base of the handrail 108 is connected to the handrail 110 by three hinges 109, as seen in FIG. 5*c*. The hinges 109 serve as an axis of rotation to "collapse" the handrails 110 when the stairway is in the stowing position (see FIG. 5*c*). The handrail locking assembly 121 affixes the handrails in place when the stairway is in the useable position (i.e., the handrails 110 are upright). The handrail locking assembly consists of a long bar with three L-shaped pins that slide through holes in support 113, as shown in FIGS. 5*a* and 5*b*. When the handrail is in the upright position, the L-shaped pins slide into the hinge assembly 109, locking it into position (see FIG. 5*b*). When the L-shaped pins slide out the holes in the hinge assembly, the handrail is free to move about the hinge axis, allowing the handrail to fold inward towards the staircase steps, as shown in FIG. 5*a*. Furthermore, the handrails 110 are of a sufficient distance to the steps 100 so as to comply with OSHA standards. In one preferred embodiment the handrails 110 are comprised of a trapezoidal shaped bar, the distance between the upper portion of that trapezoid and the bottom portion is approximately 9 inches. In the preferred embodiment, the tops of the handrails 110 are at a distance of approximately 38 vertical inches when measured from the center of each step 100. The handrails 110 can be folded up or down independently of whether the stairway is in the stowing or useable position (see FIGS. 1-3).

The underside of the stairway is supported by a plurality of metal bars in a cross-shaped pattern 111 and 112. In one preferred embodiment, two bars, 111 and 112, make and X shape on the underside of the stairway, and three Xs are placed adjacent to one another through the length of the stairway. The cross-shaped bars provide further structural integrity to the stairway. In one preferred embodiment, the bars 111 and 112 are approximately 4 feet 8 inches each.

The description contained herein is for purposes of illustration and not for purposes of limitation. Changes and modifications may be made to the embodiments of the description and still be within the scope of the invention. Furthermore, obvious changes, modifications or variations will occur to those skilled in the art. Also, all references cited above are incorporated herein by reference, in their entirety, for background and to assist the reader of this disclosure.

While the invention has been shown and described herein with reference to particular embodiments, it is to be understood that the various additions, substitutions, or modifications of form, structure, arrangement, proportions, materials, and components and otherwise, used in the practice and which are particularly adapted to specific environments and operative requirements, may be made to the described embodiments without departing from the spirit and scope of the present invention. Accordingly, it should be understood that the embodiments disclosed herein are merely illustrative of the principles of the invention. Various other modifications may be made by those skilled in the art which will embody the principles of the invention and fall within the spirit and the scope thereof.

I claim:

1. A stairway apparatus comprising:

A plurality of steps, an upper and lower end, wherein the upper end is affixed to an upper surface and wherein the stairway terminates at the upper surface when it is in a useable position;

at least one wheel located at the upper end and at least one wheel at the lower end, wherein said at least one wheel at the upper end is attached to a mounting bracket comprising:

at least one angle iron having a vertical surface and a horizontal surface affixed to the upper surface, a first piece, having at least two substantially parallel sides, one of the at least two substantially parallel sides affixed to the vertical surface of the angle iron, a second piece, having a generally u-shaped profile, affixed to the first piece and having two substantially parallel sides, one of the two substantially parallel sides of the second piece affixed to the other of the at least two substantially parallel sides of the first piece, and the second piece is attached to at least one rail that encases the at least one wheel at the upper end wherein the at least one wheel is movable along the at least one rail at a pivot point, a third piece connected to the first piece and the second piece and affixed to the stairway such that the third piece interlocks with the second piece when the stairway is in the useable position, and allowing the stairway to move from a stowing position wherein the stairway is near vertical, approximately −5 degrees from vertical, to the useable position wherein the stairway is at approximately 45 degrees from vertical; and the stairway further comprising handrails connected on each side of the stairway that can be folded inward towards the stairs when the stairway is in the stowing position.

2. The apparatus of claim 1, wherein the plurality of steps are connected to two parallel bars that run the length of the stairway and are in contact with the front and back end of each stair, the uppermost stair being adjacent to the upper surface when the stairway is in the useable position.

3. The apparatus of claim 1, wherein the handrails are folded inward through the use of a hinge and a pin to lock the handrails in the upright position.

4. The apparatus of claim 1, wherein at least one vertical supporting structure is placed on the upper surface and is adjacent to the handrails of the stairway when in the useable position.

5. The apparatus of claim 1, wherein the upper end of the stairway is affixed to the upper surface with the mounting bracket, said mounting bracket comprising:

at least one piece of angle iron attached to the upper surface at wall studs and ceiling joists;

a second piece of angle iron affixed beneath the top step of the stairway, said second piece of angle iron interlocking with the at least one piece of angle iron securing the top of the stairway level with the upper surface.

6. A stairway apparatus comprising:

an upper end and a lower end, wherein the upper end is affixed to an upper surface, wherein the stairway terminates at the upper surface when it is in a useable position;

at least two wheels located at the upper end of the stairway wherein one of said wheels is on one side of the stairway and one of said wheels is located on the other side of the stairway, said at least two wheels affixed to the upper surface with a mounting bracket comprising:

at least one angle iron having a vertical surface and a horizontal surface affixed to the upper surface, a first piece, having at least two substantially parallel sides, one of the at least two substantially parallel sides affixed to the vertical surface of the angle iron, a second piece, having a generally u-shaped profile, affixed to the first piece and having two substantially parallel sides, one of the two substantially parallel sides of the second piece is affixed to the other of the at least two substantially parallel sides of the first piece, and the second piece is attached to at least two rails that encase the at least two wheels at the upper end, wherein the at least two wheels are movable along the at least two rails at a pivot point as the stairway moves from the useable position to a stowing position, and from the stowing position to the useable position;

a third piece connected to the first piece and the second piece and affixed to the stairway such that the third piece interlocks with the second piece when the stairway is in the useable position; and wherein the two rails are affixed to the upper one-third under side of the stairway; a third wheel and a fourth wheel located at the lower end of the stairway wherein the third wheel is on one side of the stairway and the fourth wheel is located on the other side of the stairway, and wherein said third and fourth wheels allow the stairway to move from the stowing position wherein the stairway is near vertical, approximately −5 degrees from vertical, to the useable position where the stairway is at approximately 45 degrees from vertical;

a plurality of steps connected to two parallel bars that run the length of the stairway and are in contact with the front and back end of each step, the uppermost step being adjacent to the upper surface when the stairway is in the useable position; and handrails connected on each side of the stairway that can be folded inward towards the steps when the stairway is in the stowing position.

7. The apparatus of claim 6, wherein the plurality of steps have dimensions of width and length, a distance from one another, and an anti-skid covering.

8. The apparatus of claim 6, wherein there is at least one vertical supporting structure is placed on the upper surface and is adjacent to the handrails of the stairway when in the useable position.

9. The apparatus of claim 6, wherein the handrails are folded inward through the use of a hinge and a pin to lock the handrails in the upright position.

10. The apparatus of claim 6, wherein the upper end of the stairway is affixed to the upper surface with the mounting bracket, said mounting bracket comprising:

the least one piece of angle iron attached to the upper surface at wall studs and ceiling joists; and the third piece affixed beneath the top step of the stairway, said third piece being in contact with the at least one piece of angle iron securing the top of the stairway level with the upper surface when the stairway is in the useable position.

11. A stairway apparatus comprising:

an upper end and a lower end, wherein the upper end is affixed to an upper surface with a mounting bracket comprising:

at least one angle iron having a vertical surface and a horizontal surface affixed to the upper surface at wall studs and ceiling joists, a first piece, having at least two substantially parallel sides, one of the at least two substantially parallel sides affixed to the vertical surface of the angle iron, a second piece, having a generally u-shaped profile, affixed to the first piece and having two substantially parallel sides, one of the two substantially parallel sides of the second piece affixed to the other of the at least two substantially parallel sides of the first piece, and the second piece is attached to at least two rails that encase at least two wheels at the upper end wherein the at least two wheels are movable along the at least two rails at a pivot point;

a third piece, having an angle profile, affixed beneath a top step of the stairway such that the third piece interlocks with the second piece when the stairway is in the useable position, securing the stairway level with the upper surface; and the mounting bracket affixed to the upper surface, wherein the stairway ends at the upper surface when it is in a useable position and the lower end is affixed to a floor when the stairway is in the useable position;

wherein one of said wheels is on one side of the stairway and one of said wheels is located on the other side of the stairway, said at least two wheels affixed to the upper surface with the mounting bracket and being in contact with said at least two rails, the two wheels substantially encased within and moveable along said at least two rails at a pivot point as the stairway moves from the useable position to a stowing position, and from the stowing position to the useable position wherein the two rails are affixed to the upper one-third under side of the stairway;

at least two additional wheels located at the lower end of the stairway, wherein one additional wheel is on one side of the stairway and one additional wheel is located on the other side of the stairway, and wherein said at least two wheels allow the stairway to move from the stowing position wherein the stairway is near vertical, approximately −5 degrees, to the useable position where the stairway is at approximately 45 degrees from vertical;

a plurality of steps that are connected to two parallel bars on each side of each step that run the length of the stairway and are in contact with the front and back end of each step, the uppermost step being adjacent to the upper surface when the stairway is in the useable position; and handrails connected on each side of the stairway that can be folded inward towards the steps when the stairway is in the stowing position.

12. The apparatus of claim 11, wherein there is at least one vertical supporting structure is placed on the upper surface and is adjacent to the handrails of the stairway when in the useable position.

13. The apparatus of claim 11, wherein the handrails are folded inward through the use of a hinge and a pin to lock the handrails in the upright position.

14. The apparatus of claim 1, wherein the at least one rail is attached beneath the upper one-third of the staircase, allowing the staircase to roll into a closed position.

* * * * *